US005714935A

United States Patent [19]

Ryan, Jr.

[11] Patent Number: 5,714,935

[45] Date of Patent: Feb. 3, 1998

[54] ARTICLE OF MERCHANDISE WITH CONCEALED EAS MARKER AND EAS WARNING LOGO

[75] Inventor: Joseph M. Ryan, Jr., Lantana, Fla.

[73] Assignee: Sensormatic Electronics Corporation, Deerfield Beach, Fla.

[21] Appl. No.: 383,570

[22] Filed: Feb. 3, 1995

[51] Int. Cl.[6] ..... G08B 13/14

[52] U.S. Cl. ..... 340/572; 40/538; 283/74

[58] Field of Search ..... 340/568, 571, 340/572; 40/299, 625, 538; 283/72, 74, 81

[56] References Cited

U.S. PATENT DOCUMENTS

| | | | |
|---|---|---|---|
| 3,493,955 | 2/1970 | Minasy | 340/572 |
| 3,665,448 | 5/1972 | McGlinchey et al. | 340/572 X |
| 3,713,133 | 1/1973 | Nathans | 340/572 X |
| 3,942,829 | 3/1976 | Humble et al. | 292/316 |
| 4,063,229 | 12/1977 | Welsh et al. | 340/280 |
| 4,336,531 | 6/1982 | Kincaid | 340/568 |
| 4,510,489 | 4/1985 | Anderson, III et al. | 340/572 |
| 4,650,219 | 3/1987 | Sigman | 283/74 X |
| 4,660,025 | 4/1987 | Humphrey | 340/572 |
| 4,745,401 | 5/1988 | Montean | 340/572 |
| 5,079,541 | 1/1992 | Moody | 340/572 X |
| 5,083,814 | 1/1992 | Guinta et al. | 283/74 X |
| 5,276,435 | 1/1994 | Rossides | 340/571 X |

FOREIGN PATENT DOCUMENTS

| | | | |
|---|---|---|---|
| 440306 | 8/1991 | European Pat. Off. | 40/299 |
| 2210235 | 6/1989 | United Kingdom | 340/572 |

*Primary Examiner*—Thomas Mullen

*Attorney, Agent, or Firm*—Robin, Blecker, Daley and Driscoll

[57] ABSTRACT

An inventory of goods is protected from theft by affixing to at least some of the items of the inventory an electronic article surveillance marker. An indicia which indicates the presence of the marker is also applied to the items of the inventory. In some cases, the indicia may be applied to goods to deter theft thereof even though no EAS marker is present on the goods. The indicia may be provided whether the marker is affixed in a concealed or visible location on the goods and may also provide guidance as to how to activate or deactivate the marker.

50 Claims, 4 Drawing Sheets

ARTICLE OF MERCHANDISE WITH CONCEALED EAS MARKER AND EAS WARNING LOGO

FIELD OF THE INVENTION

This invention relates to electronic article surveillance (EAS) systems.

BACKGROUND OF THE INVENTION

It is well known to provide electronic article surveillance systems to prevent or deter theft of merchandise from retail establishments. In a typical system, markers designed to interact with an electromagnetic or magnetic field placed at the store exit are secured to articles of merchandise. If a marker is brought into the field or "interrogation zone," the presence of the marker is detected and an alarm is generated.

One type of system, known as an "harmonic" EAS system, is based on markers which include a thin strip or wire of magnetic material that responds to an alternating interrogation signal by generating a signal pulse that is rich in high harmonics of the interrogation signal. Markers of this kind are disclosed in U.S. Pat. No. 4,660,025 to Humphrey and U.S. Pat. No. 4,980,670 to Humphrey et al.

Another type of EAS system employs magnetomechanical markers that include a magnetostrictive element. For example, U.S. Pat. No. 4,510,489, issued to Anderson et al., discloses a marker formed of a ribbon-shaped length of a magnetostrictive amorphous material contained within a hollow recess in an elongated housing in proximity to a biasing magnetic element. The magnetostrictive element is fabricated such that it is mechanically resonant at a predetermined frequency when the biasing element has been magnetized to a certain level. At the interrogation zone, a suitable oscillator provides an AC magnetic field at the predetermined frequency, and the magnetostrictive element mechanically resonates at this frequency upon exposure to the field when the biasing element has been magnetized to the aforementioned level. The resulting signal radiated by the magnetostrictive element is detected by detecting circuitry provided at the interrogation zone.

The biasing element in a magnetomechanical marker functions as a control element, since the marker can be activated or deactivated, as the case may be, by changing the degree of magnetization of the biasing element. It is also known to provide a control element in a harmonic system marker whereby the harmonic system marker can be activated or deactivated by changing the state of magnetization of the control element.

One of the concerns in operating an EAS system is that the system may be defeated by removing the marker from the article of merchandise. To prevent this from happening, it is known to use a device (such as that disclosed in U.S. Pat. No. 3,942,829) which quite securely attaches the marker to the article of merchandise. It is also known to affix the marker to the article of merchandise in a concealed or camouflaged manner. For example, U.S. Pat. No. 4,063,229, issued to Welsh et al., proposes that an EAS marker be integrated with a price label or embedded or incorporated in the product itself or in product packaging.

It is also proposed in U.S. patent application Ser. No. 08/314,087, filed Sep. 28, 1994, now U.S. Pat. No. 5,499,015 (which is commonly assigned with the present application), that a magnetomechanical EAS marker be incorporated with a product or its packaging by housing a magnetostrictive element in a cavity integrally formed in the product or product package while mounting a biasing element adjacent to the housing. The just-mentioned patent application further proposes that the active element for a harmonic EAS marker be coated with a lubricant and then embedded by molding or the like in a plastic component of a product or product package.

It will be recognized that embedding a marker in an article of merchandise may, depending on the manner in which embedding is performed, prevent removal of the marker by concealing the location of the marker and/or by making it very difficult to physically separate the marker from the article of merchandise. It also may be more efficient to affix the marker to the article (e.g. by embedding the marker in the article) during the manufacturing process, rather than applying the marker to the article at the store.

Although the concealment of EAS markers in articles of merchandise, by embedding or otherwise, may be advantageous in terms of efficiency and preventing unauthorized removal of the marker, there are also disadvantages that accrue from concealment of the marker. For example, since readily visible markers may tend to deter theft of the merchandise, concealing the marker may reduce the overall deterrent effect of an EAS system. Also, it may be difficult for store employees to locate concealed markers for the purpose of deactivating or activating the markers, depending on the type of activator or deactivator device being used. It would be desirable to avoid some or all of these disadvantages, while continuing to realize some or all of the benefits of embedded or concealed markers.

OBJECTS AND SUMMARY OF THE INVENTION

It is accordingly a primary object of the invention to enhance the deterrent effect of EAS systems that employ concealed or embedded EAS markers.

It is a further object to reduce the cost of employing EAS systems.

It is yet another object to facilitate activation or deactivation of concealed or embedded EAS markers.

According to an aspect of the invention, there is provided a method of protecting an inventory of goods from theft, including the steps of affixing an electronic article surveillance marker to each of at least some items of the inventory, and applying to each of the at least some items an indicia indicative of the presence of the marker. According to further practice in accordance with this aspect of the invention, the method further includes the step of applying the indicia to some items of the inventory which lack the EAS marker.

According to another aspect of the invention, there is provided an electronic article surveillance system for protecting an inventory of goods from theft, including generating circuitry for generating a magnetic field alternating at a selected frequency in an interrogation zone, a first plurality of items of the inventory of goods, each item of the first plurality including an electronic article surveillance marker affixed to the item for generating a marker signal when exposed to the alternating field and an indicia applied to the item for indicating the presence of the marker, a second plurality of items of the inventory of goods, each item of the second plurality having no electronic article surveillance marker but having an indicia applied to the item of the second plurality, with the indicia applied to the items of the second plurality being the same as the indicia applied to the items of the first plurality, and detecting circuitry for detecting the marker signal generated by the EAS marker.

BRIEF DESCRIPTION OF THE DRAWINGS

The same or similar reference numerals are used throughout the drawings to designate the same or similar parts.

DESCRIPTION OF THE PREFERRED EMBODIMENTS

Figure 1:
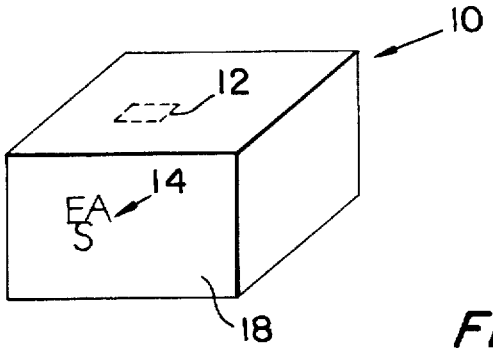
FIG. 1 is a perspective view of an article of merchandise according to a first embodiment of the invention.

A first embodiment of the invention will now be described with reference to FIG. 1. In FIG. 1, reference numeral 10 generally indicates an article of merchandise, in which there is provided a concealed EAS marker 12 (shown in phantom). For example, the marker 12 may be of any of the types of marker disclosed in the above-referenced Humphrey, Humphrey et al., Anderson et al. and Welsh et al. patents. It is also contemplated that the marker 12 could be of the type used in so-called "microwave" EAS systems, like the markers disclosed in U.S. Pat. No. 4,063,229, issued to Welsh et al. As another alternative, the marker 12 could be of the type used in so-called "RF" EAS systems, wherein the marker includes an electrical circuit that is resonant at a selected frequency in the radio frequency range. The marker 12 may be affixed to the article of merchandise 10 by adhesive, by physically embedding or incorporating the marker 12 in the article 10, or by other techniques. Concealment of the marker 12 may be accomplished by positioning the marker 12 within an opaque housing or wrapper (not separately shown) for the article 10, or by physically embedding all elements of the marker 12 within an opaque portion of the article 10.

Figure 2:
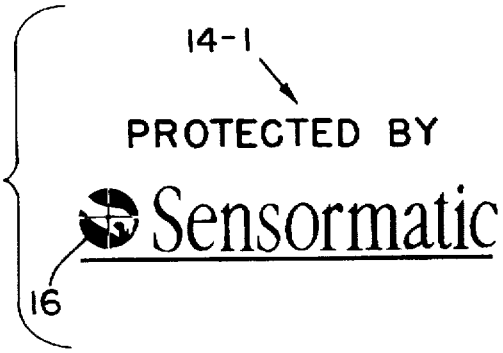
FIGS. 2–5 show alternative versions of a logo shown in FIG. 1, and FIGS. 5A–5F show further alternative versions of the logo.

The article 10 also bears a logo 14, which is shown in FIG. 1 as a stylized representation of the letters "EAS", and which serves to indicate the presence of the marker 12 within the article 10. The logo or indication 14 may take many forms, and may be presented or promoted in such a way as to become distinctive and readily recognized by the public. Other forms for the indication 14 are shown in FIGS. 2–5. For example, FIG. 2 shows an indication 14-1 which includes the words "PROTECTED BY Sensormatic," associated with the corporate logo 16 of Sensormatic Electronics Corporation (which is the assignee of the present application). Another alternative form of the indication is shown as indication 14-2 in FIG. 3, and consists of the words "PROTECTED BY AN ELECTRONIC ARTICLE SURVEILLANCE LABEL".

Figure 3:
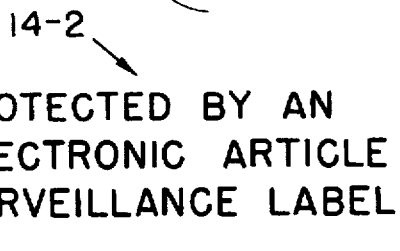
Figure 5:
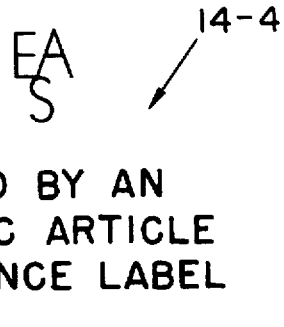
Figure 4:
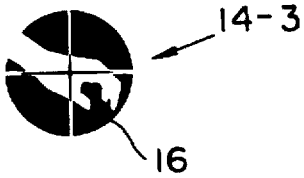
Figure 5A:
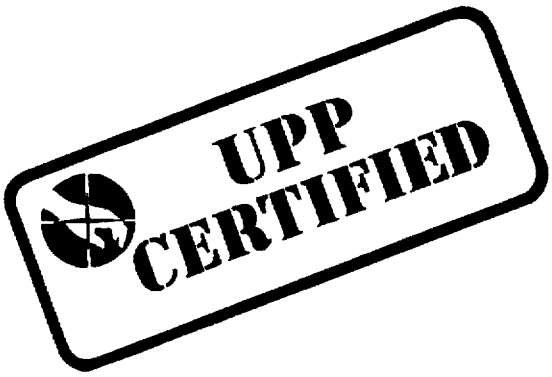
Figure 5B:
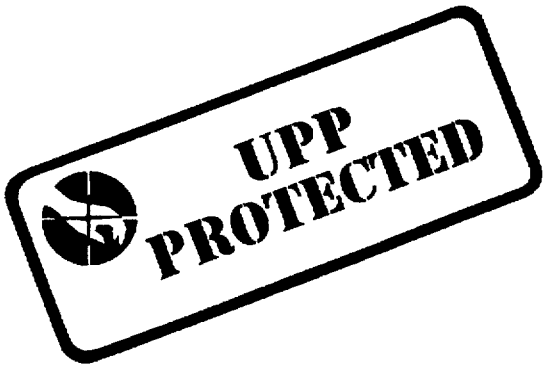
Figure 5C:
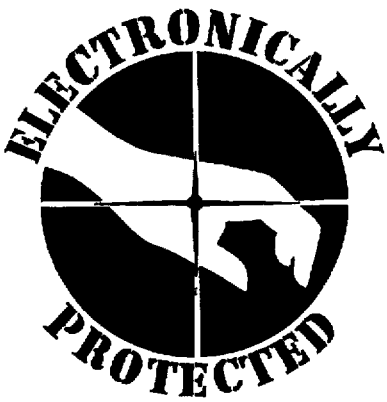
Figure 5D:
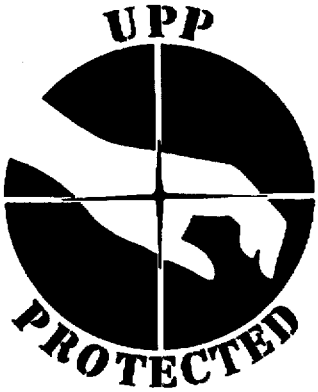
Figure 5E:
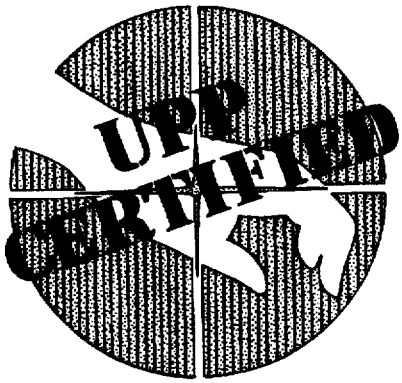
Figure 5F:
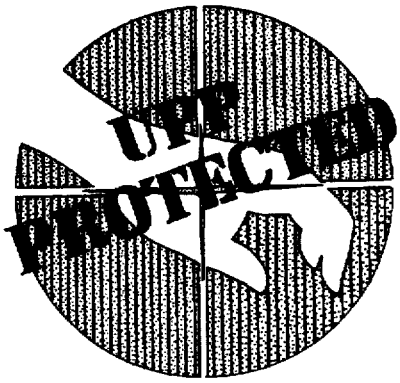

Still another alternative indication 14-3, shown in FIG. 4, consists of the Sensormatic logo 16 by itself, while another alternative indication 14-4, shown in FIG. 5, is a combination of the indications 14 and 14-2 shown respectively in FIGS. 1 and 3.

Other alternative indications are shown in FIGS. 5A through 5F. It will be noted that each of these indications includes the Sensormatic logo and words such as "UPP CERTIFIED", "UPP PROTECTED", or "ELECTRONICALLY PROTECTED". The term "UPP" is understood to be indicative of a source tagging program sponsored by Sensormatic and known as "Universal Product Protection".

Figure 6:
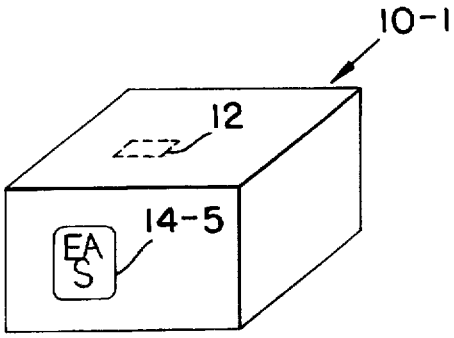
FIG. 6 is a perspective view of an article of merchandise according to a second embodiment of the invention.

The indication 14 may be applied to the article 10 in a number of ways. For example, taking the outline of article 10 shown in FIG. 1 as representing packaging 18 for the article, the logo 14 may be printed directly on the packaging 18. Alternatively, as shown in FIG. 6, a second embodiment 10-1 of the article of merchandise includes the logo in the form of a sticker 14-5 applied to the article 10-1.

According to the embodiment shown in FIGS. 1 and 3, the indication 14 is positioned on the article 10 at a location which is not related to or indicative of the location on article 10 at which the marker 12 is affixed to the article 10. Accordingly, the indication 14 does not betray the location of the marker 12. At the same time, the indication 14 provides a warning to potential malefactors that the article 10 is protected by electronic article surveillance. The indication 14 therefore aids in deterring theft of the article 10. The indication 14 may also be useful as a reminder to store employees that the article 10 includes a marker 12 that might require activation or deactivation.

Figure 7:
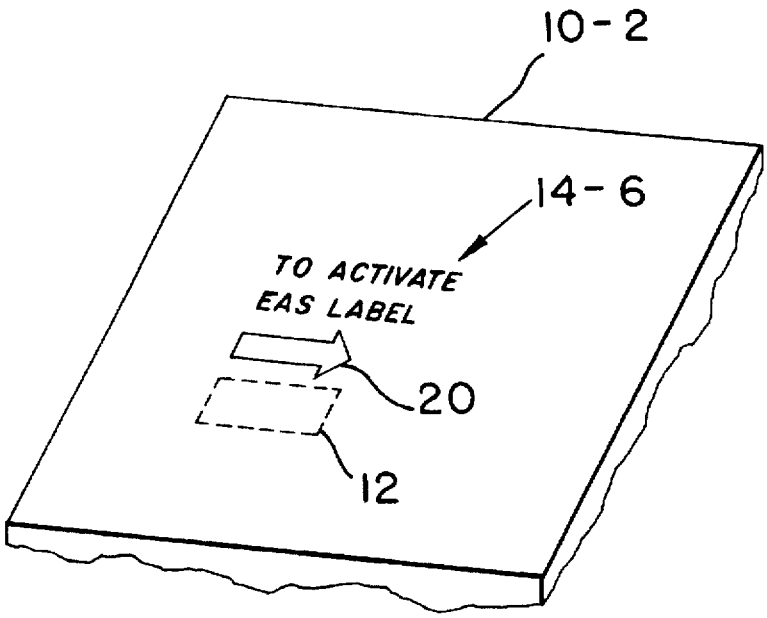
FIGS. 7 and 8 are partial perspective views of articles of merchandise according to third and fourth embodiments of the invention, respectively.

According to other embodiments of the invention, an indication is provided on the article of merchandise for the purpose of aiding activation or deactivation of an EAS label affixed to the article of merchandise. For example, FIG. 7 shows a portion of an article 10-2, which has printed thereon an indication 14-6. The indication 14-6 includes an arrow 20 which indicates both a location and a direction for moving an activation device (not shown) so as to activate a marker 12 affixed in a concealed fashion within the article 10-2.

Hand-held activation devices are known to those of ordinary skill in the art, and may include a magnet which, when moved at the location and in the manner indicated by the arrow 20, imparts a magnetized state to a component of the marker 12 such that the marker is activated.

Figure 8:
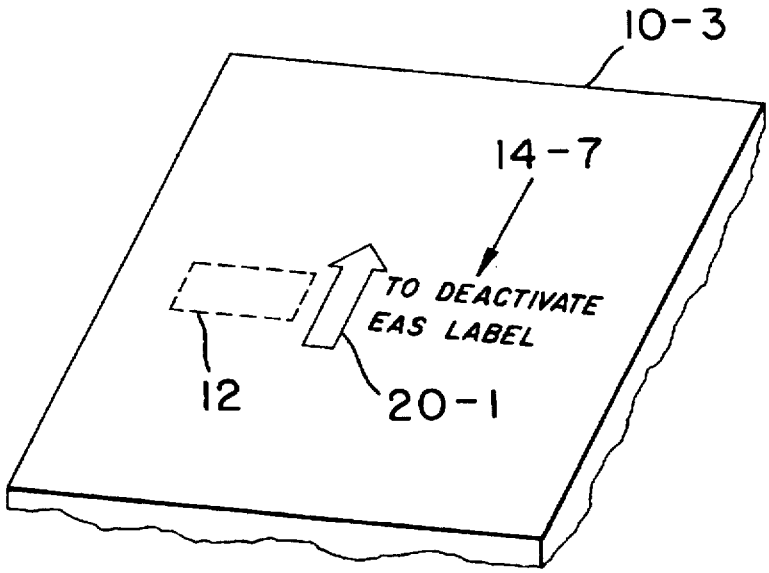

Similarly, in FIG. 8, an article of merchandise 10-3 has printed thereon an indication 14-7, which includes an arrow 20-1. The arrow 20-1 indicates a location on the article 10-3 and a direction for placing and moving a deactivation device (not shown) to be used for deactivating the marker 12 affixed in a concealed fashion in the article 10-3. Again, hand-held deactivation devices are known, and may include a magnet which changes a magnetic state of a component of the marker 12 so as to deactivate the marker when the magnet is moved at the location and in the direction indicated by the arrow 20-1.

As is known to those of ordinary skill, an electrostatic field may be applied to certain types of markers to activate or deactivate the same. Indications like those shown in FIGS. 7 and 8 may also be useful in connection with activation or deactivation of markers of those types. It is also contemplated to include in the indication information indicative of the type of marker affixed to the article of merchandise.

The indications 14-6 and 14-7 shown respectively in FIGS. 7 and 8 are provided to assist store employees in, respectively, activating or deactivating a concealed EAS label, and would not necessarily be helpful in deterring theft of the article by warning potential malefactors about the presence of the marker 12. However, the indications 14-6 and 14-7 may be combined with the other types of indications previously shown, thereby providing the same deterrent effect as those other indications.

It will be noted that in the form shown in FIGS. 7 and 8, the indications 14-6 and 14-7 are indicative of the location of the marker 12, and therefore may increase the risk that the marker 12 could be removed, unless the marker 12 is embedded in the article or otherwise affixed in a manner which effectively prevents removal of the marker. To overcome this disadvantage, it is contemplated to modify the indications 14-6 and 14-7, by, for example, presenting the indications in a coded form (not shown), so that trained store personnel would recognize the indications, but the meanings of the indications would not be recognized by potential malefactors. It will also be recognized that both of the indications 14-6 and 14-7 could be used on the same article.

Figure 9:
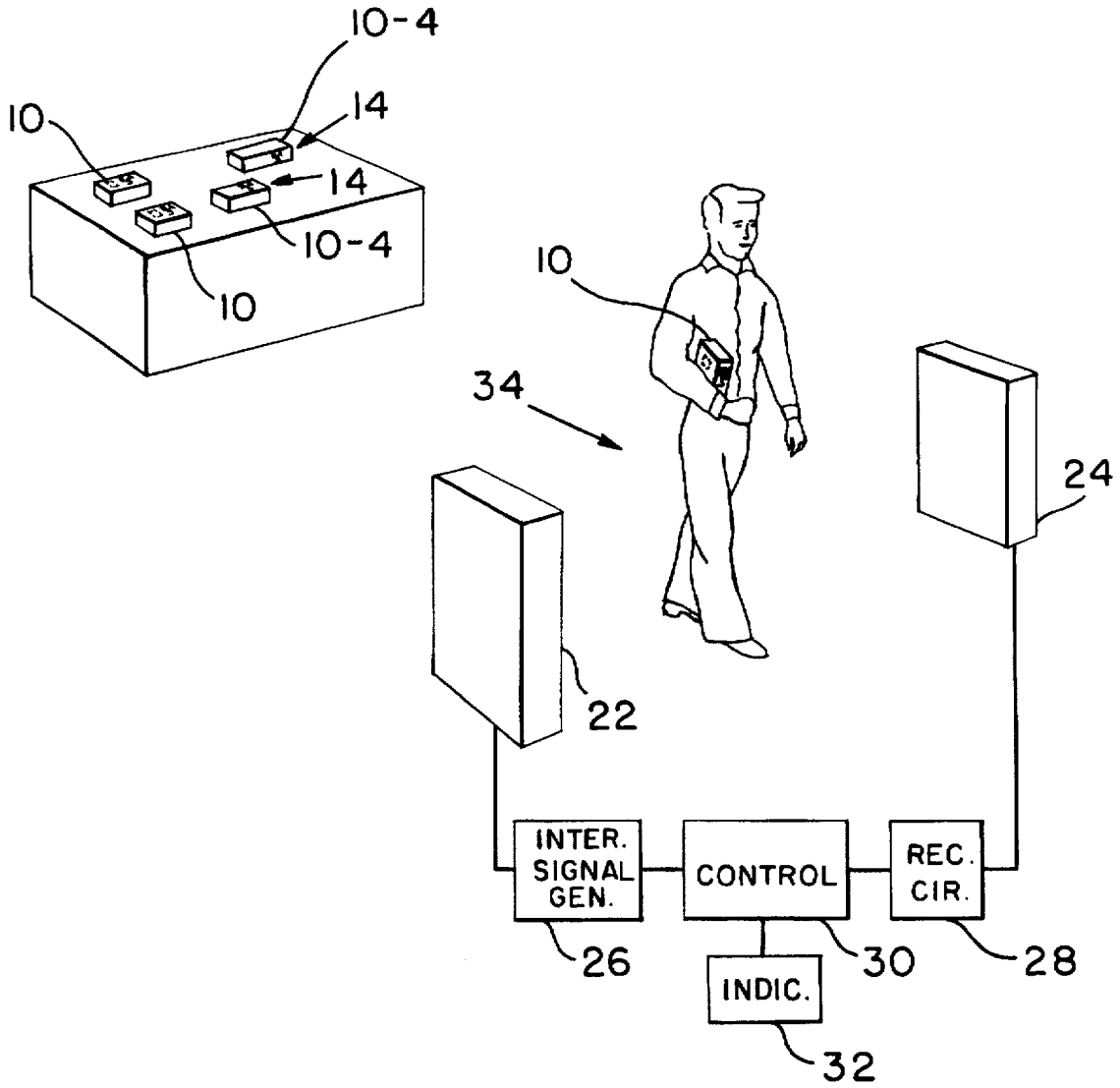
FIG. 9 is a schematic illustration of a EAS system in accordance with the invention in which an indication of the presence of an EAS marker is provided on articles of merchandise which have such a marker and also on articles of merchandise which do not have such a marker.

FIG. 9 schematically illustrates an electronic article surveillance system provided in accordance with the invention. In this system, a plurality of articles of merchandise are displayed for sale, including a plurality of articles 10 of the kind described above in connection with FIG. 1 and also a plurality of articles of merchandise 10-4 which have the same indication 14 as the articles 10, but do not have a marker 12 affixed thereto. In the case of the articles 10-4, it can be said that the indication 14 falsely indicates that an electronic article surveillance marker is present on the article 10-4.

It is to be understood that the presence of the indication 14 on the articles 10-4 will tend to deter theft of the articles 10-4, notwithstanding the fact that the articles 10-4 do not have a marker affixed thereto. The proportion of articles with false indications may be less than, equal to, or greater than the proportion of articles with both indications and markers. For example, according to one manner of practicing the invention, there may be three times as many articles having false indications as the number of articles having both indications and markers. It will be noted that omitting markers from some of the articles of merchandise saves the cost of supplying and affixing markers to those articles.

In the case of articles 10-4, which bear the false indications 14, it is contemplated to include coded information on the article, as part of the indication 14 or elsewhere, that will alert store personnel but not customers that no marker is in fact present on the article.

The system shown in FIG. 9 includes antennas 22 and 24, interrogation signal generating circuitry 26 connected to the antenna 22, receiver circuitry 28 connected to the antenna 24, a control circuit 30 connected to both of the circuits 26 and 28, and an indicator device 32 connected to the control circuit 30. In operation, the interrogation signal generating circuit 26, under control of the control circuit 30, generates an interrogation signal and drives the antenna 22 to radiate the interrogation signal within an interrogation zone 34. Signals present in the interrogation zone 34 are received by the receiver circuit 28 via antenna 24. The receiver circuit 28 conditions the received signal and provides the conditioned signal to the control circuit 30, which determines from the received signal whether an active marker is present in the interrogation zone 34.

An individual is shown carrying an article of merchandise 10 in the interrogation zone 34. If the EAS marker affixed to the article 10 is in an active condition, the marker will respond to the interrogation signal by generating a marker signal. The marker signal will be received via the antenna 24 and the receiver circuit 28 and detected by the control circuit 30, which will then actuate the indicator mechanism 32 to generate an audible and/or visible alarm indication.

Although the system of FIG. 9 is shown as being operated both with articles of merchandise 10, which have concealed markers 12 and indications 14 of the presence of the markers, and articles 10-4, which have indications that falsely indicate the presence of markers on the articles 10-4, it is also contemplated that the system be operated only with articles of merchandise 10, that is, that every article of merchandise which bears the indication 14 actually has an EAS marker 12 affixed thereto.

The elements 22 through 32 which constitute the marker detection equipment, may, for example, be magnetomechanical marker detection equipment like that sold by the assignee of the present application under the trademark "ULTRA*MAX," or, alternatively, the detection equipment may be of the harmonic type, such as the equipment sold by the assignee of the present application under the trademark "AISLEKEEPER". It should be understood that the present invention may be applied to other types of EAS systems, in addition to those which utilize harmonic or magnetomechanical markers.

Although the present invention has up to this point been explained in connection with articles of merchandise having concealed EAS markers affixed thereto, the invention also may be used with articles of merchandise on which the markers are attached in visible, and even in conspicuous, positions on the articles of merchandise. In such cases, the indications illustrated in FIGS. 1 through 6 would have the function of enhancing the deterrent effect provided by the visible presence of the marker itself. Moreover, the indications 14-6 and 14-7 shown in FIGS. 7 and 8 would provide the function of assisting store personnel in locating the markers and/or of instructing the store personnel in what orientation and/or in what direction activating or deactivating devices are to be applied to the markers.

A variety of changes in the above-described articles, systems and practices may be introduced without departing from the invention. The particularly preferred embodiments of the invention are thus intended in an illustrative and not limiting sense. The true spirit and scope of the invention is set forth in the following claims.

What is claimed is:

1. A method of protecting from theft an inventory of goods to be displayed in a retail establishment for purchase by customers, comprising the steps of:

(a) affixing an electronic article surveillance marker to each of some but not all items of said inventory;

(b) applying to each of said items having a marker affixed thereto an indicia for indicating to said customers the presence of said marker; and (c) applying said indicia indicative of the presence of an electronic article surveillance marker to some items of said inventory which lack such marker.

2. A method according to claim 1, wherein each said electronic article surveillance marker is concealed in the respective item of inventory.

3. A method according to claim 1, wherein each said electronic article surveillance marker is embedded in the respective item of inventory.

4. A method according to claim 1, wherein each said indicia is printed on a package which contains the respective item of inventory.

5. A method according to claim 1, wherein each said indicia is a sticker applied to the respective item of inventory.

6. A method according to claim 1, wherein each said indicia indicates a position at which the respective marker is affixed on the respective item of inventory.

7. A method according to claim 1, further comprising the step of deactivating said marker after said marker is affixed to the respective item of inventory.

8. A method according to claim 7, wherein said deactivating step includes applying at least one of a magnetic field and an electrostatic field at a location indicated by the respective indicia on the respective item.

9. A method according to claim 7, wherein said deactivating step includes applying at least one of a magnetic field and an electrostatic field in a direction indicated by the respective indicia on the respective item.

10. A method according to claim 1, further comprising the step of activating said marker after said marker is affixed to the respective item of inventory.

11. A method according to claim 10, wherein said activating step includes applying at least one of a magnetic field and an electrostatic field at a location indicated by the respective indicia on the respective item.

12. A method according to claim 10, wherein said activating step includes applying at least one of a magnetic field and an electrostatic field in a direction indicated by the respective indicia on the respective item.

13. A method according to claim 1 wherein said indicia is in the form of a distinctive logo.

14. A method according to claim 1, wherein said electronic article surveillance marker is a magnetomechanical marker.

15. A method according to claim 1, wherein said electronic article surveillance marker is of the type which, upon exposure to an alternating field, causes harmonic perturbations of said field.

16. A method according to claim 1, wherein said electronic article surveillance marker is of the type which includes an electrical circuit that is resonant at a selected frequency in the radio frequency range.

17. An article of merchandise to be displayed in a retail establishment for purchase by customers and protected from theft, including an electronic article surveillance marker concealed within the article of merchandise and an indicia applied to the article of merchandise for indicating a location of said marker within the article of merchandise.

18. An article according to claim 17, wherein said marker is embedded in the article.

19. An article according to claim 17, wherein said indicia is printed on a package which contains the article.

20. An article according to claim 17, wherein said indicia is a sticker applied to the article.

21. An article according to claim 17, wherein said indicia includes an arrow which indicates a direction in which to apply a magnetic field or an electrostatic field for deactivating said marker.

22. An article according to claim 17, wherein said indicia includes an arrow which indicates a direction in which to apply a magnetic field or an electrostatic field for activating said marker.

23. An article according to claim 17, wherein said marker is a magnetomechanical marker.

24. An article according to claim 17, wherein said marker is of the type which, upon exposure to an alternating magnetic field, causes harmonic perturbations of said field.

25. An article according to claim 17, wherein said marker is of the type which includes an electrical circuit that is resonant at a selected frequency in the radio frequency range.

26. An article according to claim 17, wherein said indicia is in the form of a distinctive logo.

27. An electronic article surveillance system for protecting from theft an inventory of goods to be displayed in a retail establishment for purchase by customers, comprising:

(a) generating means for generating a magnetic field alternating at a selected frequency in an interrogation zone;

(b) an item of said inventory of goods, said item including an electronic article surveillance marker concealed within said item for generating a marker signal, when exposed to said alternating field, and an indicia applied to said item for indicating a location of said marker within said item; and (c) detecting means for detecting said marker signal generated by said marker.

28. An electronic article surveillance system according to claim 27, wherein said marker is embedded in said item of inventory.

29. An electronic article surveillance system according to claim 27, wherein said indicia is printed on a package which contains said item of inventory.

30. An electronic article surveillance system according to claim 27, wherein said indicia is a sticker applied to said item of inventory.

31. An electronic article surveillance system according to claim 27, wherein said indicia includes an arrow which indicates a direction in which to apply a magnetic field for deactivating said marker.

32. An electronic article surveillance system according to claim 27, wherein said indicia includes an arrow which indicates a direction in which to apply a magnetic field for activating said marker.

33. An electronic article surveillance system according to claim 27, wherein said marker is a magnetomechanical marker.

34. An electronic article surveillance system according to claim 27, wherein said marker, upon exposure to said alternating magnetic field, causes harmonic perturbations of said field.

35. An electronic article surveillance system according to claim 27, wherein said marker is of the type which includes an electrical circuit that is resonant at a selected frequency in the radio frequency range.

36. An electronic article surveillance system for protecting from theft an inventory of goods to be displayed in a retail establishment for purchase by customers, comprising:

(a) generating means for generating a magnetic field alternating at a selected frequency in an interrogation zone;

(b) a first plurality of items of said inventory of goods, each item of said first plurality including an electronic article surveillance marker affixed to said item for generating a marker signal, when exposed to said alternating field, and an indicia applied to said item for indicating to said customers the presence of said marker;

(c) a second plurality of items of said inventory of goods, each item of said second plurality having no electronic article surveillance marker but having an indicia applied to said item of said second plurality, said indicia applied to said items of said second plurality being the same as said indicia applied to said items of said first plurality; and (d) detecting means for detecting said marker signal generated by said marker.

37. An electronic article surveillance system according to claim 36, wherein said second plurality is larger in number than said first plurality.

38. An electronic article surveillance system according to claim 36, wherein said marker affixed to each item of said first plurality is concealed in the respective item.

39. An electronic article surveillance system according to claim 36, wherein said indicia is printed on a package which contains the respective item of inventory.

40. An electronic article surveillance system according to claim 36, wherein said indicia is a sticker applied to the respective item of inventory.

41. An electronic article surveillance system according to claim 36, wherein said indicia is in the form of a distinctive logo.

42. A method of protecting an inventory of goods from theft, comprising the steps of:

(a) affixing an electronic article surveillance marker at a concealed location in each of at least some items of said inventory; and (b) applying to each of said at least some items an indicia which indicates the concealed location at which the respective marker is affixed on the respective item of inventory.

43. A method according to claim 42, further comprising the step of deactivating said marker after said marker is affixed to the respective item of inventory by applying at least one of a magnetic field and an electrostatic field at a location indicated by the respective indicia on the respective item.

44. A method according to claim 42, further comprising the step of activating said marker after said marker is affixed to the respective item of inventory by applying at least one of a magnetic field and an electrostatic field at a location indicated by the respective indicia on the respective item.

45. A method of protecting an inventory of goods from theft, comprising the steps of:

(a) affixing an electronic article surveillance marker at a concealed location in each of at least some items of said inventory;

(b) applying an indicia to each of said at least some items, said indicia for indicating the concealed location at which the respective marker is affixed on the respective item of inventory;

the method further comprising at least one of the following steps:

(c) deactivating said marker after said marker is affixed to the respective item of inventory by applying at least one of a magnetic field and an electrostatic field at the location indicated by the respective indicia on the respective item; and (d) activating said marker after said marker is affixed to the respective item of inventory by applying at least one of a magnetic field and an electrostatic field at the location indicated by the respective indicia on the respective item.

46. A method of protecting an inventory of goods from theft, comprising the steps of:

(a) affixing an electronic article surveillance marker to each of at least some items of said inventory;

(b) applying an indicia to each of said at least some items;

the method further comprising at least one of the following steps:

(c) deactivating said marker after said marker is affixed to the respective item of inventory by applying at least one of a magnetic field and an electrostatic field in a direction indicated by the respective indicia on the respective item; and (d) activating said marker after said marker is affixed to the respective item of inventory by applying at least one of a magnetic field and an electrostatic field in a direction indicated by the respective indicia on the respective item.

47. An article of merchandise to be protected from theft, including an electronic article surveillance marker concealed within the article of merchandise and an indicia applied to the article of merchandise for indicating a position at which said marker is concealed within the article.

48. An article of merchandise to be protected from theft, including an electronic article surveillance marker affixed to the article of merchandise and an indicia applied to the article of merchandise for indicating a direction in which to apply a magnetic field or an electrostatic field for activating or deactivating said marker.

49. An electronic article surveillance system for protecting an inventory of goods from theft, comprising:

(a) generating means for generating a magnetic field alternating at a selected frequency in an interrogation zone;

(b) an item of said inventory of goods, said item including an electronic article surveillance marker concealed within said item for generating a marker signal when exposed to said alternating field, and an indicia applied to said item for indicating a position at which said marker is concealed within said item of inventory; and (c) detecting means for detecting said marker signal generated by said marker.

50. An electronic article surveillance system for protecting an inventory of goods from theft, comprising:

(a) generating means for generating a magnetic field alternating at a selected frequency in an interrogation zone;

(b) an item of said inventory of goods, said item including an electronic article surveillance marker affixed to said item for generating a marker signal when exposed to said alternating field, and an indicia applied to said item for indicating a direction in which to apply a magnetic field for activating or deactivating said marker;

(c) detecting means for detecting said marker signal generated by said marker.

* * * * *